US005531616A

United States Patent [19]

Forestello

[11] Patent Number: 5,531,616

[45] Date of Patent: Jul. 2, 1996

[54] INDICATOR LAMP

[75] Inventor: Philippe Forestello, Soyaux, France

[73] Assignee: Schneider Electric SA, Boulogne Billancourt, France

[21] Appl. No.: 273,934

[22] Filed: Jul. 12, 1994

[30] Foreign Application Priority Data

Jul. 12, 1993 [FR] France ..... 93 08657

[51] Int. Cl.[6] ..... H01R 17/18

[52] U.S. Cl. ..... 439/668; 439/611; 439/801; 439/893

[58] Field of Search ..... 439/557, 558, 439/611–619, 699, 702–707, 668, 801, 893

[56] References Cited

U.S. PATENT DOCUMENTS 1,310,191 7/1919 Hubbard et al. ..... 439/705
1,738,366 12/1929 Goodridge ..... 439/706
2,605,317 7/1952 Tiscione ..... 439/419
2,784,393 3/1957 Mysse .

FOREIGN PATENT DOCUMENTS 1260624 2/1968 Germany ..... 439/558
3340658A1 5/1985 Germany .

*Primary Examiner*—David L. Pirlot
*Attorney, Agent, or Firm*—Oblon, Spivak, McClelland, Maier & Neustadt

[57] ABSTRACT

An indicator lamp includes a hollow body which accommodates a luminous component supplied with power by conductors connected to screw terminals and closed at the front by a transparent cap. The terminals are staggered relative to the axis of the indicator lamp and at least one screw axis is at an acute angle to the indicator lamp axis.

11 Claims, 2 Drawing Sheets

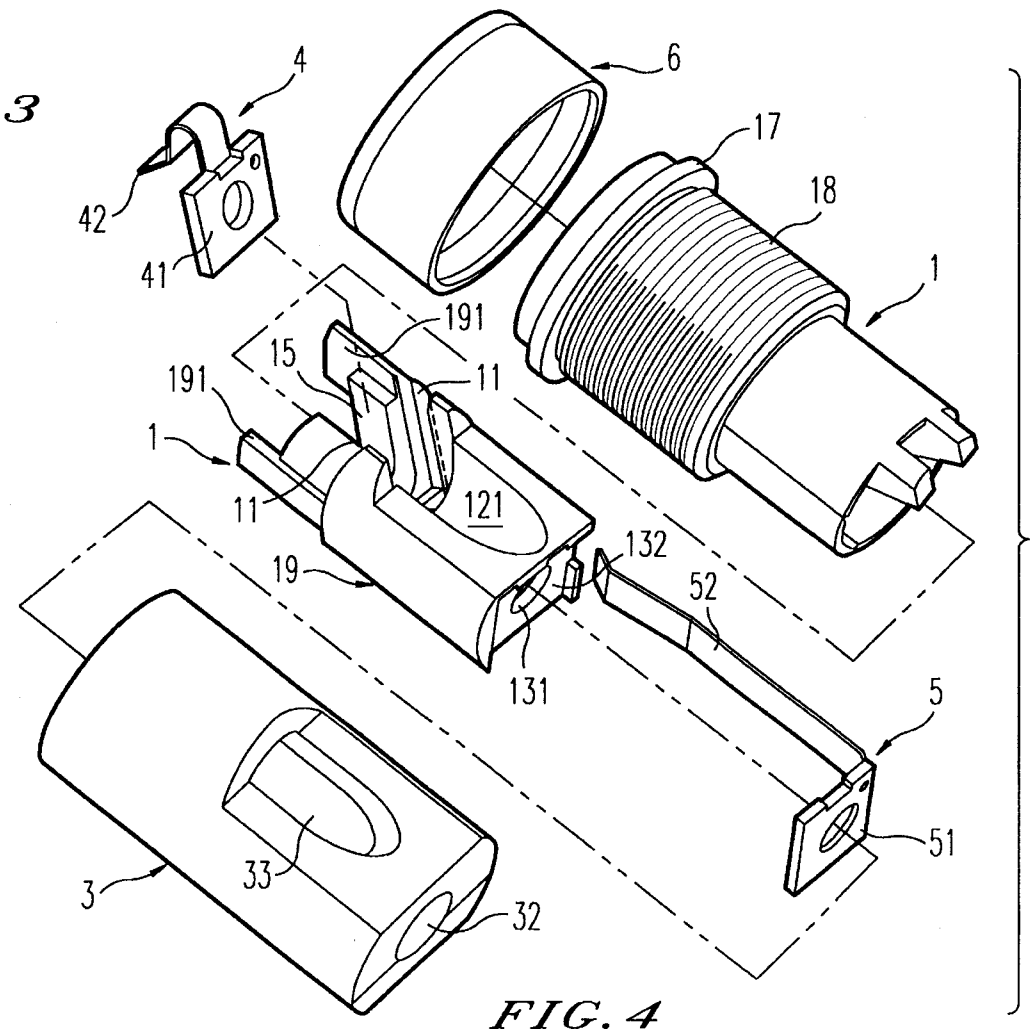
FIG. 4
FIG. 3
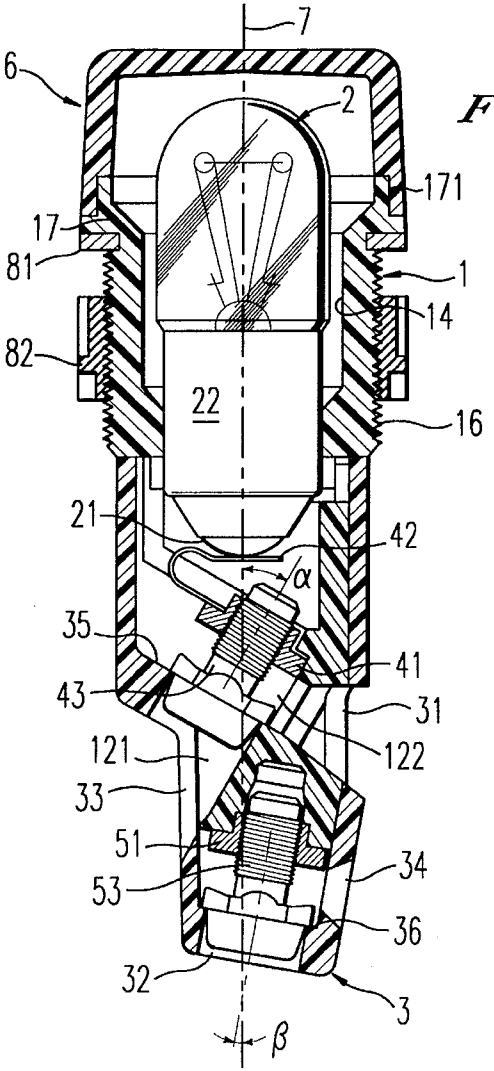

INDICATOR LAMP

BACKGROUND OF THE INVENTION

1. Field of the Invention

The present invention concerns an indicator lamp for use in systems controlling and monitoring electrical or electronic installations or equipment.

2. Description of the Prior Art

In such installations indicator lamps which can be easily connected by screws and washers to conductor wires are required for indicating circuits that are live, correct operation or the occurrence of faults.

French patent No 2 616 207 describes an economical indicator lamp comprising a plastics material body in which a lampholder is held and which is closed by a cap. The screw terminals which supply power to the lamp are in a common plane transverse to the lamp axis.

SUMMARY OF THE INVENTION

An object of the present invention is to provide a compact monolithic indicator lamp for connection by screws and washers. This lamp provides easy access for wiring and the screws are retained by a terminal-cover.

The indicator lamp of the invention comprises a hollow body adapted to accommodate a luminous component supplied with power by conductors connected to screw terminals and closed at the front by a transparent cap, wherein the terminals are staggered relative to the axis of the indicator lamp and at least one screw axis is at an acute angle to the indicator lamp axis.

According to one feature of the invention the body has housings for accommodating parts supporting the screw terminals and attached to the conductors supplying power to the luminous component and a rear end of the body is surrounded by a cap providing access for the power supply conductors to the terminals and access for a screw operating tool.

According to one feature of the invention the luminous component is fixed directly into the body.

According to one feature of the invention the cap forms abutments adapted to limit the unscrewing travel of the screws.

The invention will now be described in more detail with reference to embodiments of the invention shown by way of example in the appended drawings.

BRIEF DESCRIPTION OF THE DRAWINGS

FIG. 3 is a view in axial section of a second embodiment of indicator lamp of the invention.

FIG. 4 is an exploded view of the lamp from FIG. 3.

DESCRIPTIQN OF THE PREFERRED EMBODIMENTS

Figure 2:
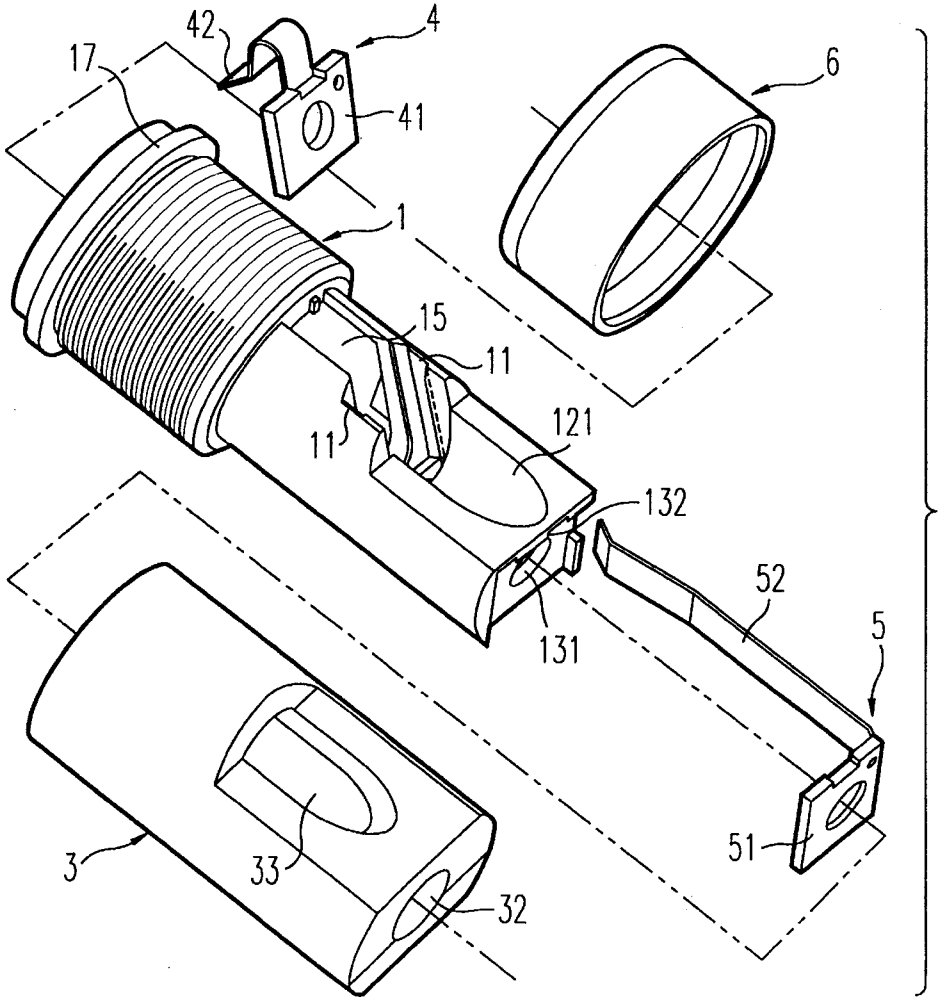
FIG. 2 is an exploded view of the lamp from FIG. 1.

The indicator lamp shown in the drawings comprises a hollow plastics material body 1 closed at the front by a transparent cap 6 and in which is housed a luminous component 2 supplied with power via conductors 42, 52 connected to terminals 4, 5 including screws 43, 53.

The luminous component 2 shown in the drawings is an incandescent lamp having a bayonet or Edison screw cap. The luminous component 2 could equally well be a neon lamp or a light-emitting diode.

The hollow body 1 is generally tubular in shape with a central axis 7 and has a bore 14 with a cylindrical part to guide and fix the cap 22 of the lamp and a part widening towards the front which surrounds the glass bulb of the lamp.

The lamp 2 is guided and immobilized in the bore 14 of the body 1 in a known manner. If the lamp 2 has a bayonet cap the bore 14 of the body 1 has notches to receive the lugs projecting from the sides of the lamp cap. If the lamp 2 has an Edison screw cap the bore 14 of the body 1 has an interior screwthread into which the cap of the lamp is screwed.

The colored or clear transparent cap 6 is made from plastics material.

The body 1 has, to the rear of a flange 17, an exterior screwthread 16 for fixing the indicator lamp into a panel opening or support and, to the front of the flange 17, an end-piece 171 for fixing the cap 6. The shoulder formed by the flange 17 has a seal 81 on the same side as the screwthread 16. The flange 17 abuts the panel on one side and the cap 6 on the other side. To fix it the indicator lamp is inserted into an opening in the panel and fixed by screwing a nut 82 onto the exterior screwthread 16.

Figure 1:
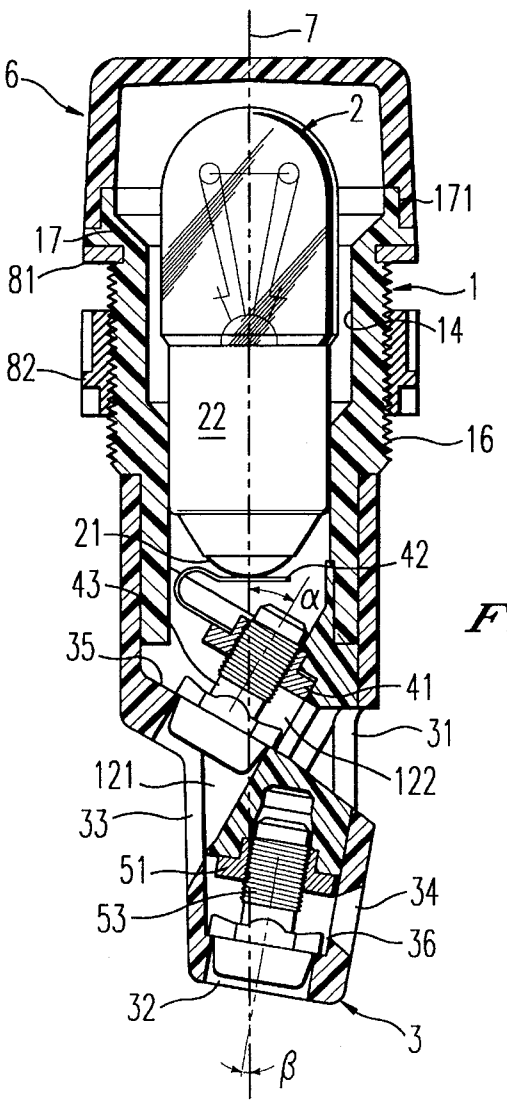
FIG. 1 is a view in axial section of a first embodiment of indicator lamp of the invention.

In the embodiment shown in FIGS. 1 and 2 the body 1 is in one piece.

In the embodiment shown in FIGS. 3 and 4 the body 1 comprises a bush 18 for fixing the lamp 2 and the cap and a terminal block 19 carrying the terminals. The bush 18 terminates at the rear in an opening closed by the terminal block 19. The terminal block 19 is made from plastics material and is assembled to the plastics material bush 18 by tenons 191 which are sleeved into the housing of the bush 18. The bush 18 and the terminal block 19 are fixed together by any appropriate known means.

The body 1 has housings 11, 121, 131, 132 in which are accommodated the screws 43, 53 and the members 41, 51 known as captive nuts supporting the latter.

The rear end of the body 1 is surrounded by a cap 3 allowing power supply conductor wires to reach the terminals 4, 5 and providing access for a tool for operating the screws 43, 53.

The plastics material cap 3 is sleeved over a cylindrical bearing surface on the body, the cap 3 and the body 1 being fastened together by any appropriate known means.

The electrical connection between the screw terminal 4 and the center terminal 21 on the lamp cap is provided by a U-shaped resilient conductive metal blade 42 one branch of which presses against the terminal 21 of the lamp. The blade 42 is fixed to the captive nut 41 provided with a screwthread into which the screw 43 is screwed, the captive nut and the screw forming the terminal 4.

The electrical connection between the screw terminal 5 and the cap 22 of the lamp is provided by a resilient conductive metal blade 52 which presses against the cap 22. The blade 52 is fixed to the captive nut 51 provided with a screwthread into which the screw 53 is screwed, the captive nut and the screw forming the terminal 5. The elastic blade 52 is inserted between the outside of the body 1 and the cap 3.

A groove 121 in the side of the body 1 houses the screw 43 and the body 1 has grooves 11 in which the captive nut 41 slides. A bore 122 through the body 1 to the rear of the captive nut 41 enables a conductor wire to reach the terminal 4. The body 1 has at the rear a blind hole 131 for the screw 53 and a housing 132 to receive the captive nut 51. A housing 15 in the body 1 enables insertion of the blade 42 into the body.

The terminals 4 and 5 are staggered along the axis 7. The plane of translation of the captive nut 41 in the grooves 11 is at an angle to the axis 7 different from 90°. The axis of the screw 43 is at an acute angle $\alpha$ to the axis 7 of the indicator lamp and the axis of the screw 53 is at an acute angle $\beta$ to the axis 7. The axis of the screw 43 near the lamp is more steeply inclined to the axis 7 of the indicator lamp than the axis of the screw to the rear of the indicator lamp.

The terminal cover cap 3 has a slot 31 for the conductor wire to be connected to the terminal 4, facing the bore 122, and an opening 34 for the conductor wire to be connected to the terminal 5. It has an opening 33 for inserting a screwdriver for operating the screw 43 and an opening 32 for inserting a screwdriver for operating the screw 53.

The cap 3 has a shoulder 35 adapted to limit the unscrewing travel of the screw 43 and a shoulder 36 for limiting the unscrewing travel of the screw 53.

To mount the indicator lamp the assembly 4 comprising the captive nut 41, the conductive blade 42 and the screw 43 is inserted into the body 1, sliding the captive nut into the grooves 11. The assembly 5 comprising the captive nut 51, the conductive blade 52 and a screw 53 is inserted into the housing 131, 132. The blade 52 is inserted between the body 1 and the cap 3 and so retains the captive nut 51 and the associated screw. The terminal cover 3 is fixed to the body 1.

When a lamp 2 is inserted in the bore in the body 1, the elastic blade 42 is pushed back and the cap 22 of the bulb is wedged in the body 1. The conductive blades 42 and 52 conduct electrical current between the lamp 2 and the terminals 4 and 5, respectively.

It is to be understood that variants and detailed improvements and even the use of equivalent means are feasible without departing from the scope of the invention.

There is claimed:

1. Indicator lamp comprising;

a hollow body;

a luminous component positioned in the hollow body, said luminous component being supplied with power by conductors connected to first and second screw terminals and closed at a front portion thereof by a transparent cap, wherein said terminals are staggered along the longitudinal axis of the indicator lamp and wherein a longitudinal screw axis of one of the first and second screw terminals is at an acute angle with respect to the indicator lamp longitudinal axis.

2. Indicator lamp according to claim 1 wherein said body has housings for accommodating parts supporting said screw terminals and attached to said conductors supplying power to said luminous component and a rear end of said body is surrounded by a cap providing access for said power supply conductors to said terminals and access for a screw operating tool.

3. Indicator lamp according to claim 1 wherein said luminous component is fixed directly to said body.

4. Indicator lamp according to claim 1 wherein said body has at least one bore enabling one of said conductors to reach one of said screw terminals.

5. Indicator lamp according to claim 1 wherein one of the screw terminals is connected to said lamp by a conductive blade inserted between said body and said cap.

6. Indicator lamp according to claim 1 wherein said body has housings receiving at least one screw and a captive nut supporting said screw.

7. Indicator lamp according to claim 1 wherein said cap has openings for conductors connected to said first and second screw terminals and openings for a tool engaging and screwing the screws of said terminals.

8. Indicator lamp according to claim 1 wherein the axis of the screw of a first screw terminal in proximity with said luminous component is more steeply inclined with respect to the indicator lamp axis than the axis of the screw of a second screw terminal located to the rear of the indicator lamp.

9. Indicator lamp according to claim 1 wherein said body comprises a bush and a terminal block independent of said bush and fixed to the rear thereof.

10. Indicator lamp according to claim 1 wherein the longitudinal screw axis of each of the first and second terminals is at an acute angle with respect to the indicator lamp longitudinal axis.

11. Indicator lamp comprising:

a hollow body;

a luminous component positioned in the hollow body, said luminous component being supplied with power by conductors connected to first and second screw terminals and closed at a front portion thereof by a transparent cap wherein said terminals are staggered along the longitudinal axis of the indicator lamp, a longitudinal screw axis of one of the first and second screw terminals is at an acute angle with respect to the indicator lamp longitudinal access and wherein said cap forms abutments limiting the unscrewing travel of said screws.

* * * * *